US010035056B1

(12) United States Patent
Fernández Ogando

(10) Patent No.: US 10,035,056 B1
(45) Date of Patent: Jul. 31, 2018

(54) GOLF TEE

(71) Applicant: José Angel Fernández Ogando, Gijon (ES)

(72) Inventor: José Angel Fernández Ogando, Gijon (ES)

( * ) Notice: Subject to any disclaimer, the term of this patent is extended or adjusted under 35 U.S.C. 154(b) by 0 days.

(21) Appl. No.: 15/885,169

(22) Filed: Jan. 31, 2018

(30) Foreign Application Priority Data

Feb. 2, 2017 (EP) ..... 17000164

(51) Int. Cl.
*A63B 57/00* (2015.01)
*A63B 57/10* (2015.01)

(52) U.S. Cl.
CPC ..... *A63B 57/10* (2015.10)

(58) Field of Classification Search
CPC ..... A63B 57/10; A63B 57/16
USPC ..... D21/717
See application file for complete search history.

(56) References Cited

U.S. PATENT DOCUMENTS 1,645,001 A * 10/1927 Hodges ..... A63B 57/10 111/99
2,455,705 A * 12/1948 Seager ..... A63B 57/10 273/DIG. 2
4,783,077 A * 11/1988 Lemon ..... A63B 57/10 473/402
D315,766 S * 3/1991 Lemon ..... D21/718
D326,129 S * 5/1992 Hirschmann ..... D21/718
6,010,413 A * 1/2000 Pan-Chung ..... A63B 57/10 473/387
D479,296 S * 9/2003 McCall ..... D21/717
D485,318 S 1/2004 Bonfanti
7,066,844 B1 * 6/2006 Noggle ..... A63B 57/10 473/387
D501,902 S 2/2009 Bonfanti
9,849,360 B2 12/2017 Carroll, Jr. et al.
2005/0148410 A1 * 7/2005 DeLisle ..... A63B 57/10 473/387
2006/0276268 A1 * 12/2006 Hung ..... A63B 57/10 473/387
2009/0170638 A1 * 7/2009 Su ..... A63B 57/10 473/401
2009/0264224 A1 * 10/2009 Whitehouse ..... A63B 57/10 473/387
2016/0166898 A1 * 6/2016 Dastrup ..... A63B 57/19 473/402

* cited by examiner

*Primary Examiner* — Steven Wong
(74) *Attorney, Agent, or Firm* — Hector M. Reyes Rivera

(57) ABSTRACT

Provided are single-body golf tees having a cup shaped upper section, a cylindrical non tapered section, a bottom section having a truncated cone integrated to a conical tip section and a grasping section constituted by plurality of elongated non tapered grooves and elongated non tapered wing-like ribs along the center of the main body that have stability and grasping strength.

9 Claims, 10 Drawing Sheets

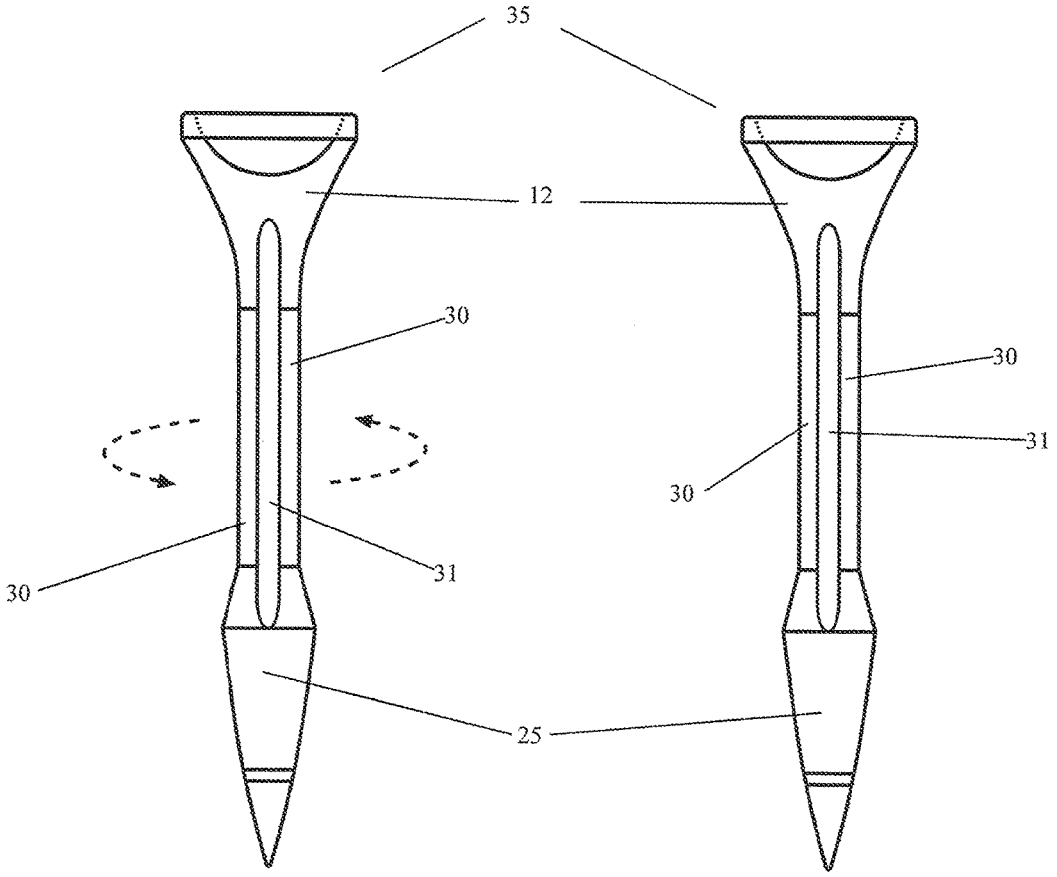
FIG. 6A
FIG. 6B
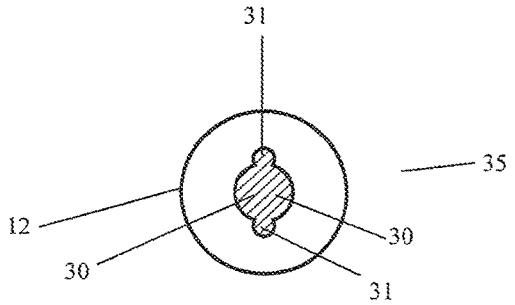
FIG. 7

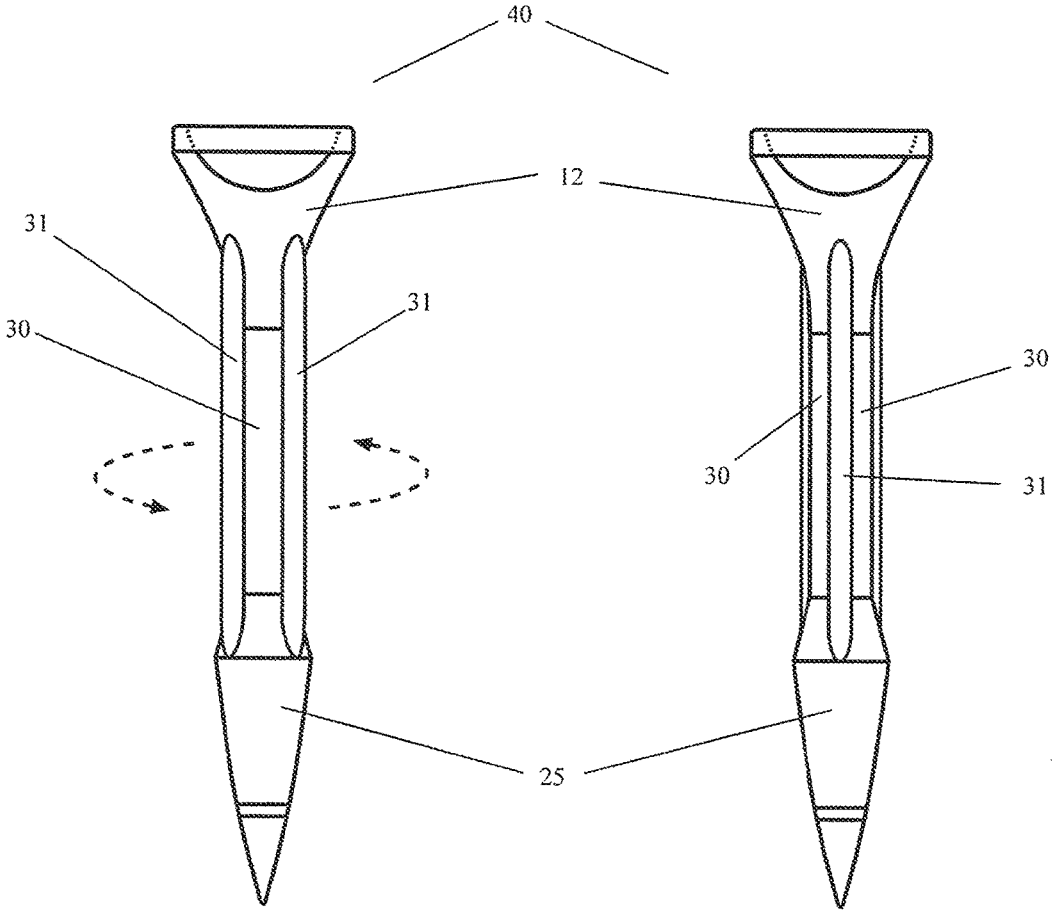
FIG. 8A
FIG. 8B
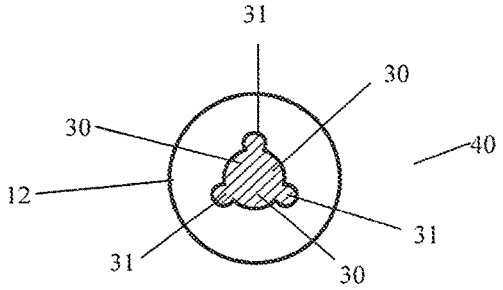
FIG. 9

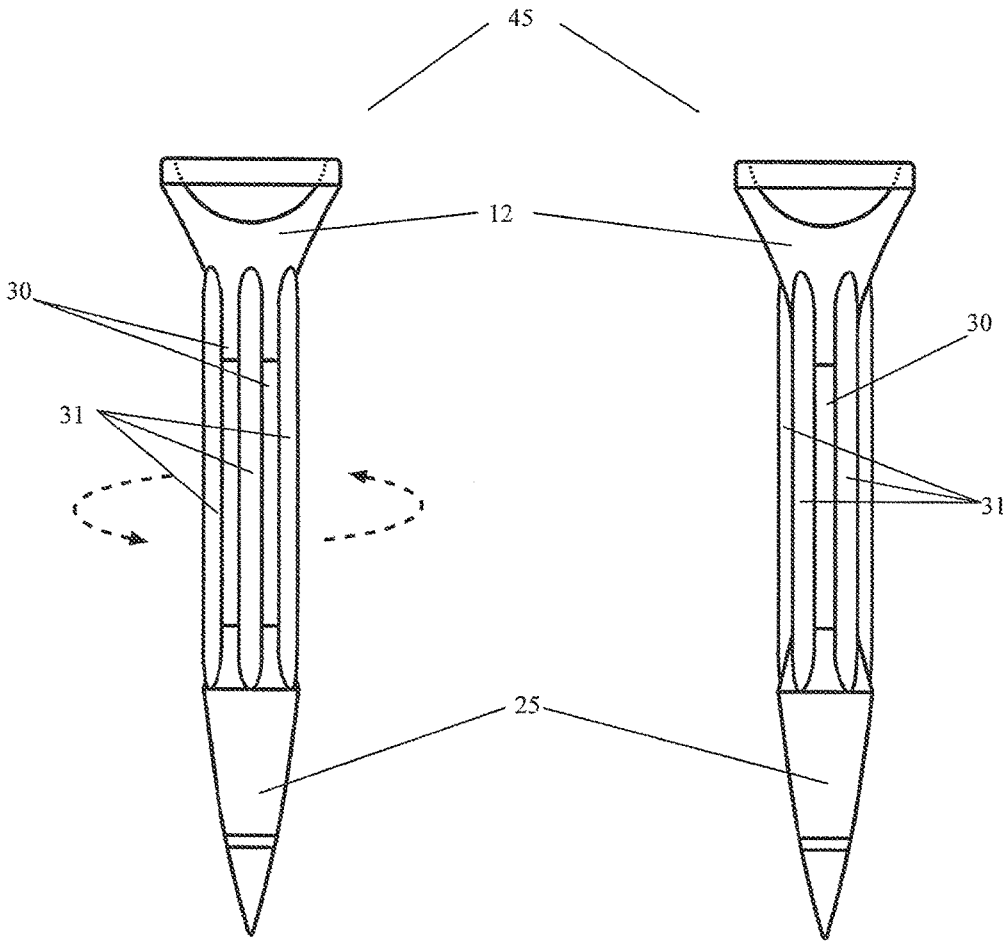
FIG. 10A
FIG. 10B
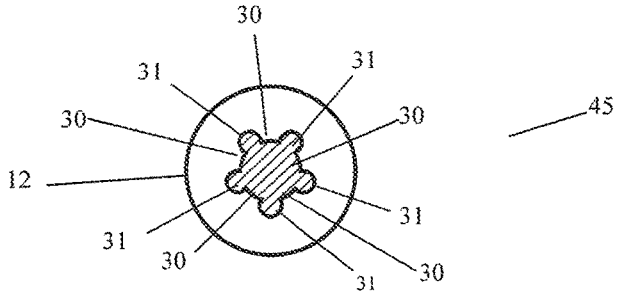
FIG. 11

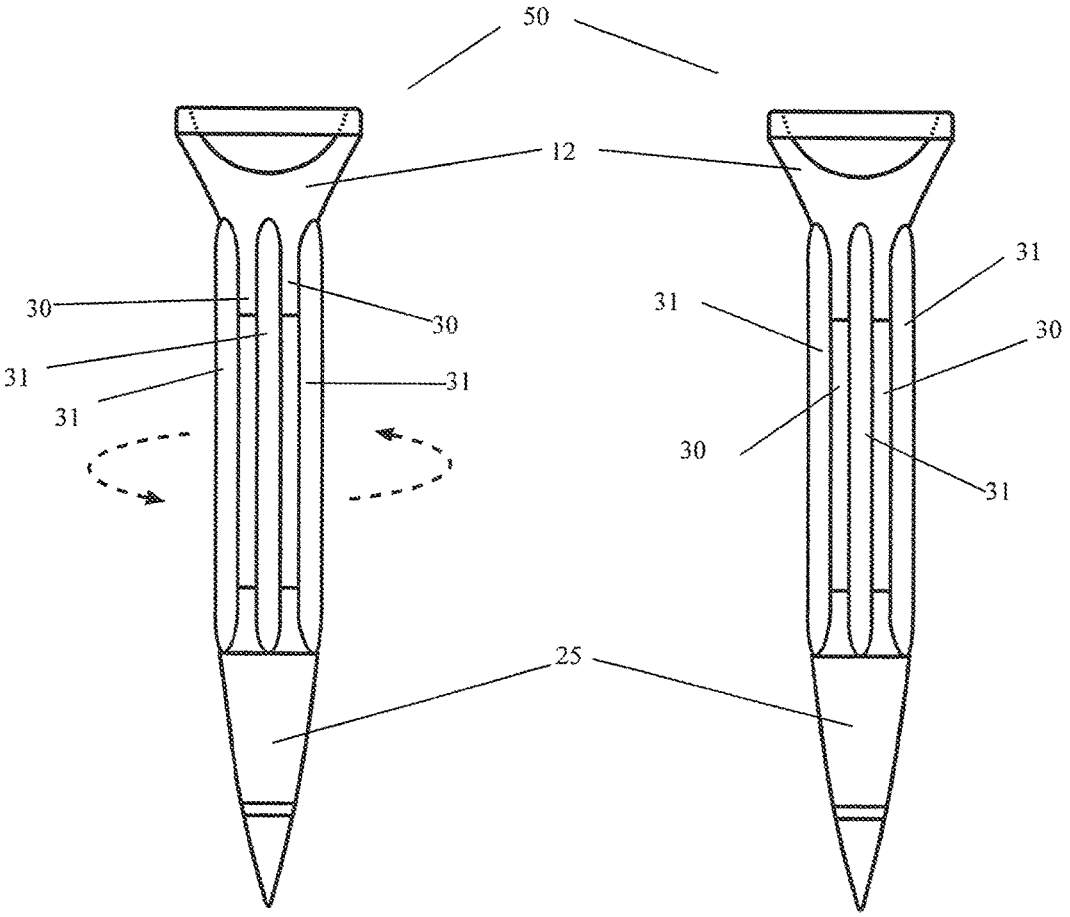
FIG. 12A
FIG. 12B
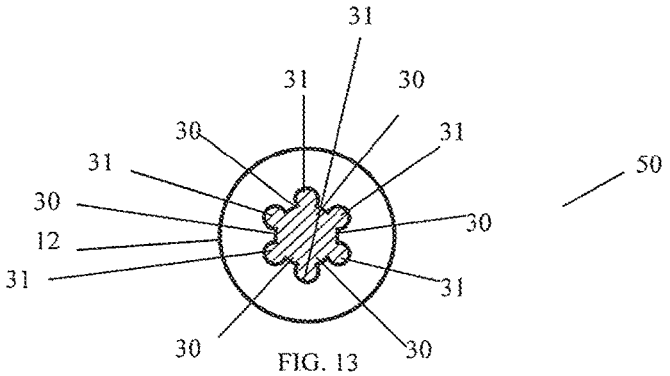
FIG. 13

GOLF TEE

This application claims priority from European Patent application 17000164.8/EP17000164 of Feb. 2, 2017, the entire disclosure of which is hereby incorporated herein by reference.

FIELD OF THE INVENTION

The invention relates to the field of golf tees. More particularly, the present invention relates to golf tees which have particular structures that includes a grasping unit constituted by a plurality of non tapered elongated grooves and non tapered elongated ribs located at the center area of the tee structure that are able to add considerable stability to the tee once it has been inserted in the ground.

BACKGROUND OF HE INVENTION

It is well known that golf players require a device called tee, which is pushed into the ground and serves as a golf ball receiver and support. The tee defines a stable resting point for the ball at the beginning of the play for each hole, in such a way that once the ball is placed on the tee, it stands above ground level, which enables the player to hit a clean shot.

However, tees usually consist of solids of revolution with a pointed bottom end to stick them in the ground and some sort of head or cup or upper section at the top to keep the ball stable, in such a way that the solid of revolution has a completely smooth outer surface and when one strikes with the golf club, if the top part of the tee happens to get struck, it flies far away and it is difficult to find.

Thus, there is a need to provide tees with higher stability and grasping strength that facilitates the strike of the ball and avoid the loss of the tees.

SUMMARY OF THE INVENTION

The tee which is being recommended successfully herein solves the aforementioned problem by means of a simple but highly effective solution. More precisely, the peculiarity of this tee is that the side surface and more specifically around the area between the point and the head or cup where the ball is placed has non tapered longitudinal ribs in the direction of the generatrix. Their number may vary and they are formed as a result of this central area having non tapered longitudinal grooves which determine the corresponding ribs as a sort of wings on the side surface of the body of the tee. In this manner, the tee maintains the classical conical configuration at the lower end, which enables to stick it in the ground, as well as the cup-shaped upper head to hold the ball, whereas the central body of the tee will make it possible to fix the tee to the ground when striking the ball.

The number of ribs or wings produced when making the longitudinal grooves on the tee can be two, three, four or any other number, since what really matters is their being there to fix the device to the ground and make it more stable, both when striking the ball and if the tee is struck by the golf club.

Therefore, due to this configuration, once the tee is struck, it lands at a shorter distance when compared to conventional tees and its makes its recovery or finding much easier. Finally, it must be mentioned that the structure of the tee is simple and easy to manufacture and, in short, its manufacturing cost and sale price are low.

BRIEF DESCRIPTION OF THE DRAWINGS

The foregoing and additional features and characteristics of the embodiments of the present invention will become more apparent from the following detailed description considered with reference to the accompanying drawings, which are used herein in a manner of example only, and wherein:

FIG. 6A illustrates a second embodiment according to the instant of invention comprising two longitudinal non tapered ribs.

FIG. 6B shows the back view of the embodiment of the golf tee illustrated in FIG. 6A once it has been rotated 180 degrees.

FIG. 7 shows a top view of a cross sectional cut of the embodiment of the invention illustrated in FIGS. 6A and 6B at any level of the ribs.

FIG. 8A illustrates a third embodiment according to the instant of invention comprising three elongated non tapered ribs.

FIG. 8B shows the back view of the embodiment of the golf tee illustrated in FIG. 8A once it has been rotated 180 degrees.

FIG. 9 shows a top view of a cross sectional cut of the embodiment of the invention illustrated in FIGS. 8A and 8B at any level of the ribs.

FIG. 10A illustrates a fourth embodiment according to the instant of invention comprising five elongated non tapered ribs.

FIG. 10B shows the back view of the embodiment of the golf tee illustrated in FIG. 10A once it has been rotated 180 degrees.

FIG. 11 shows a top view of a cross sectional cut of the embodiment of the invention illustrated in FIGS. 10A and 10B tee at any level of the ribs.

FIG. 12A illustrates a fourth embodiment according to the instant of invention comprising six non tapered longitudinal ribs.

FIG. 12B shows the back view of the embodiment of the golf tee illustrated in FIG. 12A once it is rotated 180 degrees.

FIG. 13 shows a top view of a cross sectional cut of the embodiment of the invention illustrated in FIGS. 12A and 12B tee at any level of the ribs.

DETAILED DESCRIPTION OF THE PREFERRED EMBODIMENTS

The following detailed description illustrates the invention by way of example and is not limited to the particular limitations presented herein as principles of the invention. This description is directed to enable one skilled in the art to make and use the invention by describing embodiments, adaptations, variations and alternatives of the invention. Potential variations of the limitations herein described are within the scope of the invention. Particularly, the size and shapes of the invention's elements illustrated in the discussion may be varied and still provide golf tees having different sizes or geometric shapes, that are within the scope of the instant invention.

The instant invention is directed to golf tees having a single integrated structure, which are able to be firmly inserted in the ground and properly received and support a golf ball, avoiding it to fly far away once the golf ball is hit or strike.

Figures 1A, 1B:
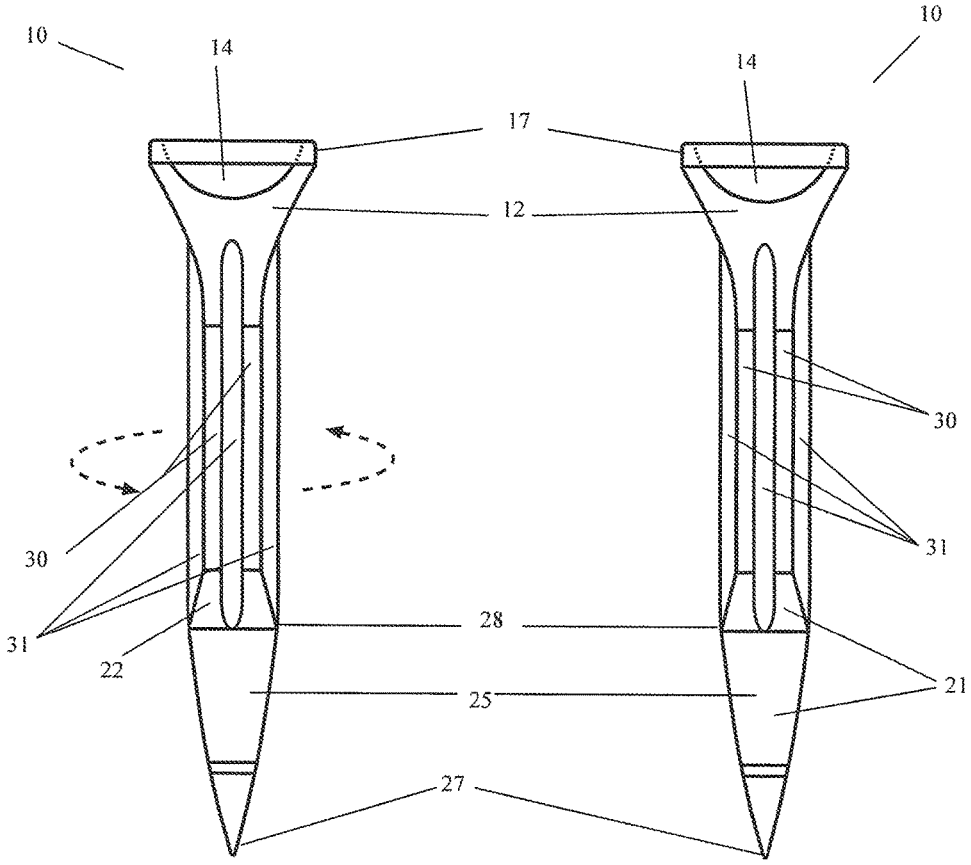
FIG. 1A shows the front view one of the embodiments of a golf tee according to the invention.
FIG. 1B shows the back view of the embodiment of the golf tee illustrated in FIG. 1A once it is been rotated 180 degrees.
Figure 2:
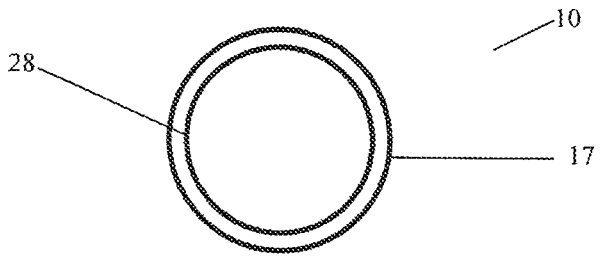
FIG. 2 shows a top view of the embodiment of the invention illustrated in FIGS. 1A and 1B.
Figure 3:
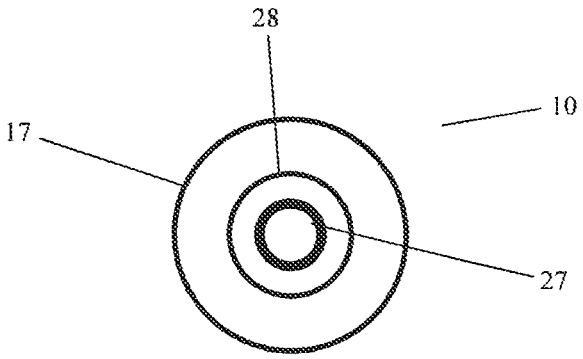
FIG. 3 shows a bottom view of the embodiment of the invention illustrated in FIGS. 1A and 1B.
Figure 4:
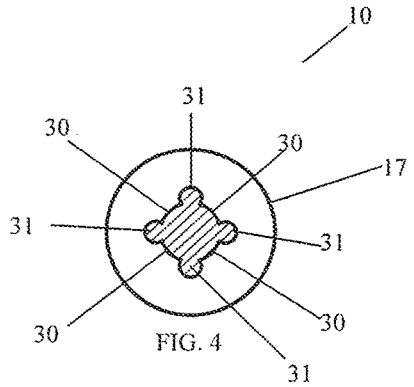
FIG. 4 shows a top view of a cross sectional cut of the embodiment of the invention illustrated in FIGS. 1A and 1B at any level of the ribs.

In reference to the drawings, FIGS. 1A, 1B, 5A and 5B represent diagrammatic representations of one embodiment according to the instant invention for golf tee 10. FIG. 1A shows a front view of embodiment 10 and FIG. 1B shows the back view of the embodiment 10 illustrated in FIG. 1A once it has been rotated 180 degrees. In FIG. 2 and FIG. 3, the top and bottom views of embodiment 10 are respectively illustrated and in FIG. 4 a top view of a cross sectional view of the embodiment 10 at any point of the ribs, for instant, the middle of the tee, is presented.

Figure 5A:
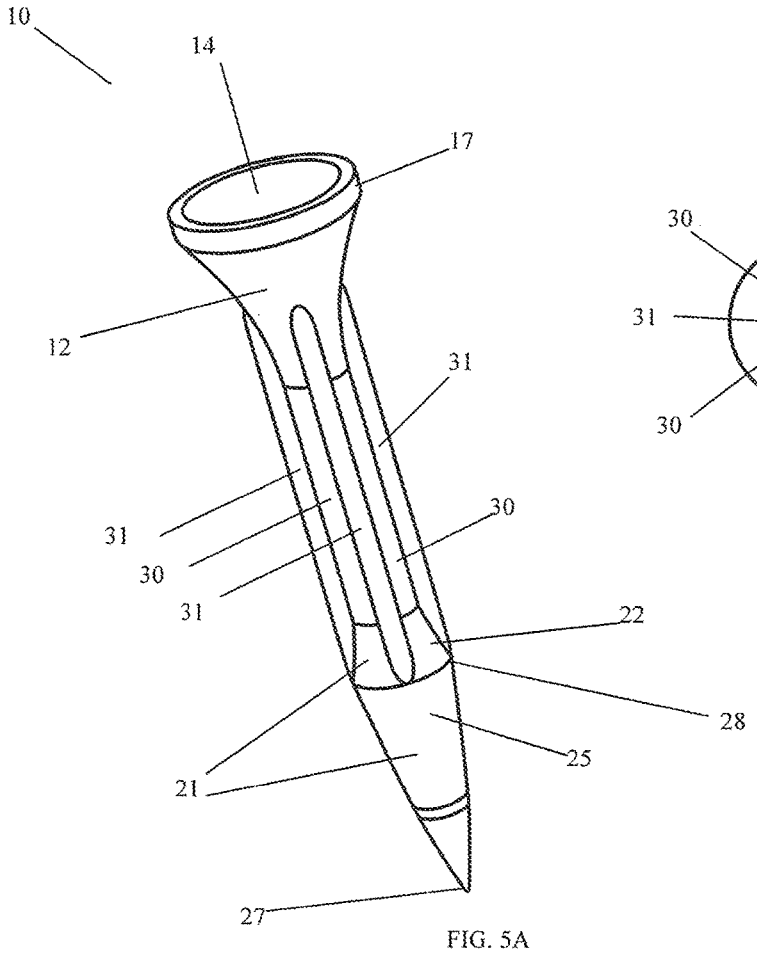
FIG. 5A shows a perspective view of the embodiment of the invention illustrated in FIGS. 1A and 1B.
Figure 5B:
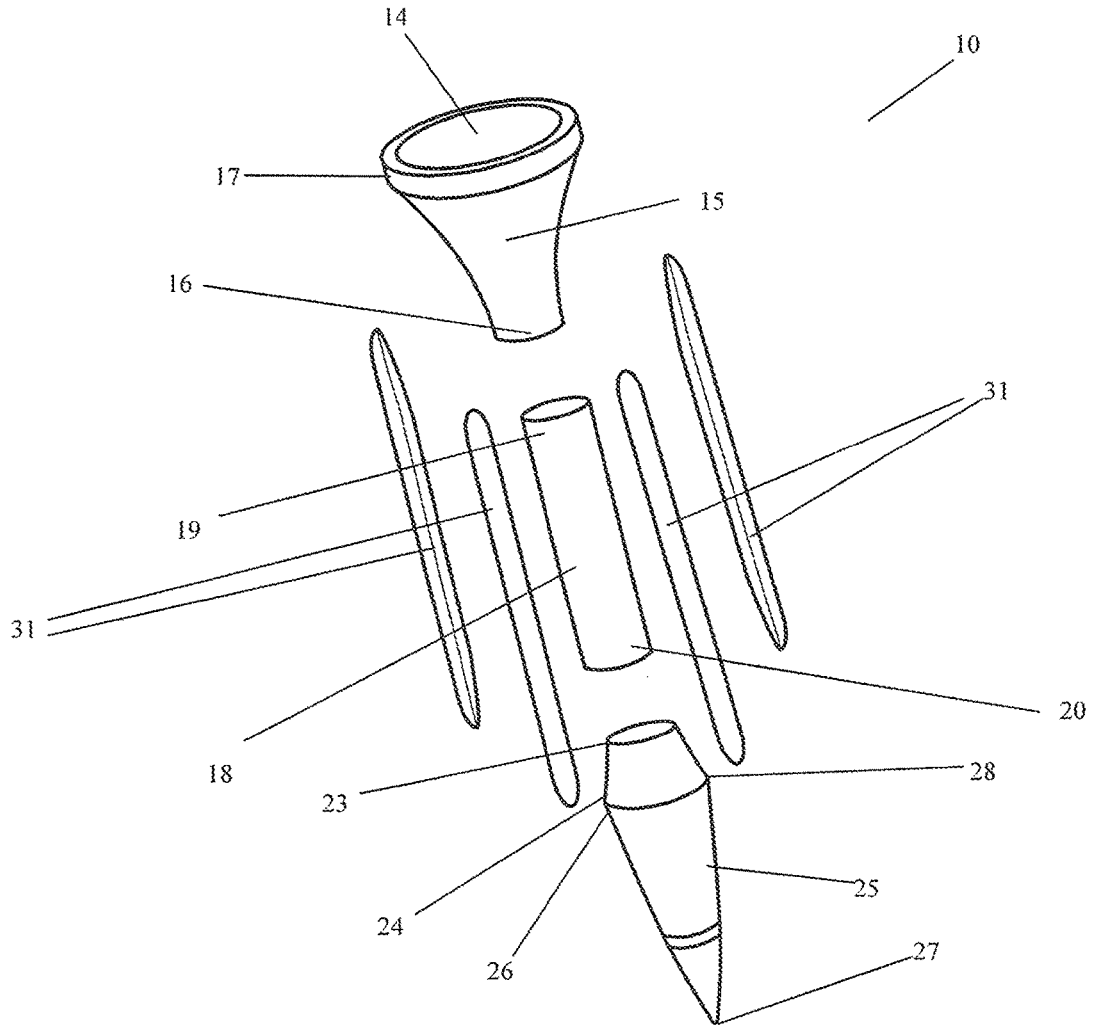
FIG. 5B illustrates an exploited view of the structure of the embodiment of the invention illustrated in FIGS. 1A and 1B presented for explicative purposes only since the tee according to the invention is indeed a single integrated structure.

In FIG. 5A, a perspective view of embodiment 10 is presented. Although all embodiments of the golf tee herein described and claimed are indeed constituted by a single integrated structure, only for the effect of its description an exploited view of embodiment 10 on FIG. 5B is provided for exclusively illustrative and for clarity in the description of its parts. As illustrated, embodiment 10 comprises top cup-shaped to section 12, which main body comprises an upper end having a concave configuration 14 capable of receiving and support a golf ball. Cup-shaped 12 has a tapered or inverted truncated cone configuration comprising a middle section 15 and lower end 16. Upper extremes 17 of cup-shaped 12 extend most outwardly from the diameter of any other parts of embodiment 10, as illustrated more clearly in FIGS. 1A, 1B, FIG. 2 and FIG. 5A.

Embodiment 10 also comprises cylindrical intermediate section 18, which maintains the same diameter along its configuration, thus cylindrical intermediate section 18 is non tapered. It comprises a first end 19 and second end 20, wherein its first end 19 is connected to the lower end 16 of the cup-shaped top section 12. As shown, for instance in FIGS. 1A, 1B, 2, 5A and 5B, the diameter of the top section 17 of cup-shaped section 12 is broader that the diameter of the intermediate section 18. On the other hand, the diameter of the lower section of cup-shaped section 12 has the same diameter of the intermediate section 18.

The lower section 21 of embodiment 10, comprises a main body having top truncated conical section 22 having first end 23 and second end 24, as indicated in FIGS. 1B and 5 B for instance. First end 23 of truncated conical section 22 is physically connected to the second end 20 of the non tapered cylindrical intermediate 18. Lower section 21 also comprises conical section 25, having a first end 26 which is physically connected to the lower section 24 of truncated conical section 22 and at the opposite position to said first end 26, the conical section 25 has a pointed end 27. The connection part 28 between the truncated conical section 22 section and the conical section 25 is the most outwardly position of the lower section 21 from the center of the embodiment 10, thus 28 it is the most external point in the lower section of embodiment 10; meaning that, the diameter of said lower section at point 28 is the most outwardly extended from the center of the embodiment 10.

Embodiment 10 also comprises a grasping section 29 constituted by four non tapered elongated grooves 30 that are positioned longitudinally from the middle section 15 of the cup-shaped top section 12 to the truncated conical section 22 of the lower section 21 in the direction of the generatrix of the non tapered cylindrical intermediate section 18. The grooves 30 on the body of embodiment 10, form or create four non tapered wing-like ribs 31, having a diameter outwardly in comparison to the diameter of the grooves 30, as illustrated more clearly in FIG. 4. non tapered wing-like ribs 31 are also positioned longitudinally from the middle section 15 of the cup-shaped top section 12 to the truncated conical section 22 of the lower section 21 in the direction of or along to the generatrix of the non tapered cylindrical intermediate section 18. As illustrated in FIGS. 1A, 1B, 5A and 5B, there is no point of contact between the concave configuration 14 capable of receiving and support a golf ball and the grooves 30 or wing-like ribs 31.

Similarly, there is no contact at all between grooves 30 or wing-like ribs 31 with the lower conical section 25 on the lower section 21 of embodiment 10. Furthermore, as shown in the cited figures, the four grooves 30 and as a consequences, the four wing-like ribs 31 of embodiment 10 are positioned and distributed in a equiangular position with respect to each other, as more clearly shown in FIG. 4, wherein a top view of a cross section view of the tee cut at any level of the wing-like ribs 31 is shown.

FIG. 2 and FIG. 3 illustrate a top and bottom views of embodiment 10 respectively. As illustrated in said views, wing-like ribs 31 are not extended outside of the maximum point of the outwardly diameter of cup-shaped section 17. In another words, taking the center of the tee embodiment 10 as a reference, the outmost outer diameter of the upper cup-shaped section 17 is farther away that the outer point of the diameter of the wing-like ribs 31. Furthermore, the outer points of the wing like ribs 31 neither are extended beyond than the maximum outer diameter 28 of the lower section 21 of embodiment 10.

As mentioned above, the described connections between: the cup-shaped top section 12, the non tapered cylindrical intermediate section 18, the lower section 21 and the grasping section 29 constitute and provide a single integral physical structure or in another words, a single body golf tee identified herein as embodiment 10.

The instant invention also includes all embodiments having any number of grooves and ribs altogether with all the characteristics or limitations already discussed for embodiment 10 for the body of the golf tee. For instance, FIG. 6A shows the front side of second embodiment 35, while FIG. 6B illustrates the back section of said second embodiment 35 once it is rotated 180 degrees. It has identical cup-shape top section 12, cylindrical section 18, bottom section 21 and grasping section 18, as already described for embodiment 10 with the exception that in embodiment 35, the number of the elongated grooves 30 and the elongated wing-like ribs 31 are respectively only two. As in embodiment 10, in embodiment 35 said grooves 30 and said wing-like ribs 31 are non tapered and equiangularly positioned, as shown in FIGS. 6A, 6B and in FIG. 7, wherein the top view of a cross section cut of the golf tee under embodiment 35 at any level of the wing-like ribs 31 is shown.

Similarly, embodiment 40 has the same already discussed above limitations of embodiment 10, but having only three non tapered grooves 30 and three non tapered wing-like ribs 31 equiangularly positioned in the body of the tee under embodiment 40. FIG. 8A shows the front and 8B shows the back of embodiment 40 after 180 degrees rotation. FIG. 9 shows a top view of cross section cut at any level of the wing-like ribs 31 of the tee under embodiment 40.

Likewise, embodiment 45 is illustrated in front and back, after 180 degrees rotation in FIGS. 10A and 10B. It also has the same limitations discussed above for embodiment 10 with the exception that it comprises five non tapered grooves 30 and five non tapered wing-like ribs 31 which are equiangularly positioned as illustrated in FIGS. 10A, 10B. In FIG. 11, a top view of a cross section cut at any level of the wing-like ribs 30 on the golf tee under embodiment 45 is shown.

Figures 14A, 14B:
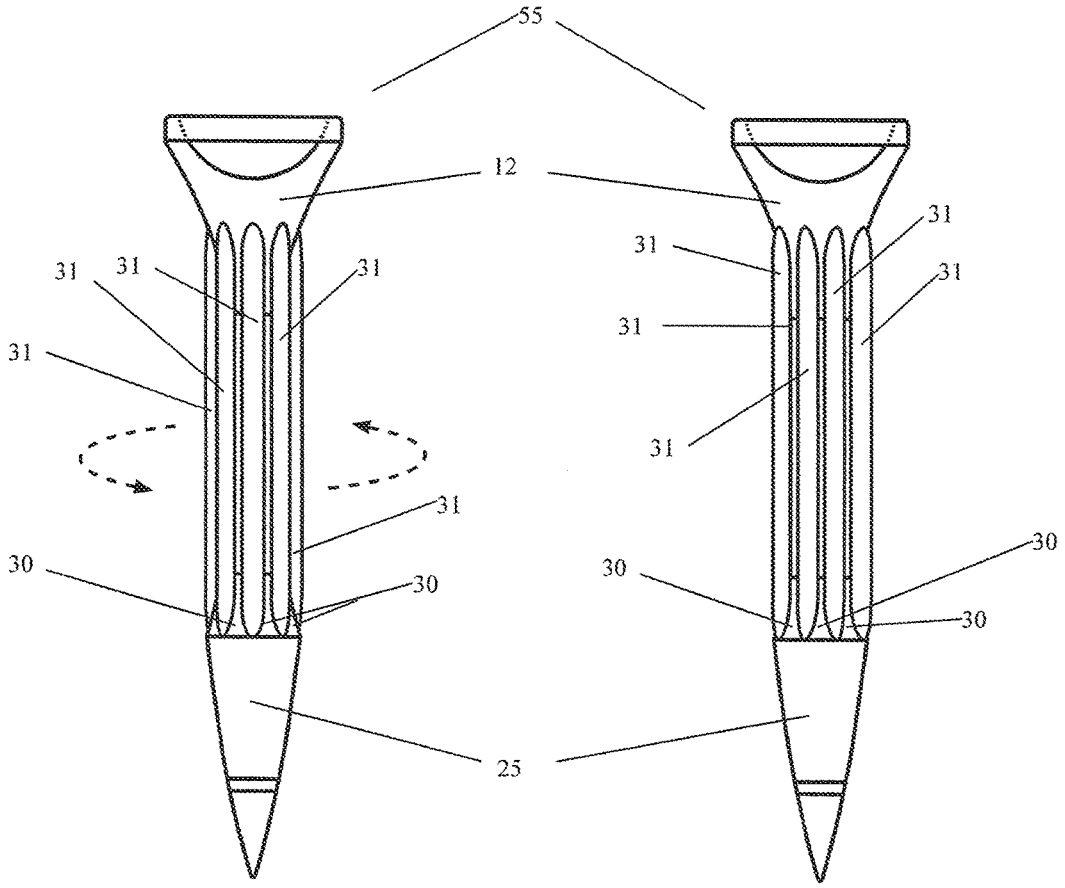
FIG. 14A illustrates a fourth embodiment according to the instant of invention comprising seven longitudinal non tapered ribs.
FIG. 14B shows the back view of the embodiment of the golf tee illustrated in FIG. 14A once it is rotated 180 degrees.
Figure 15:
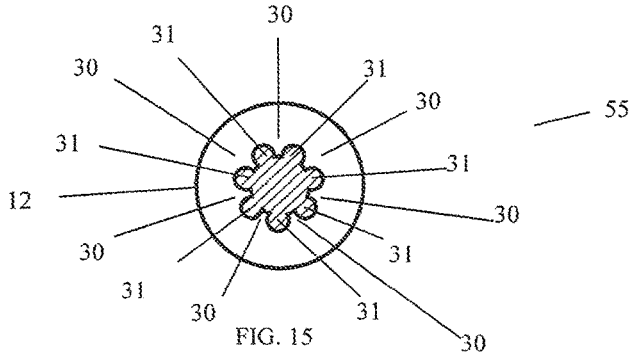
FIG. 15 shows a top view of a cross sectional cut of the embodiment of the invention illustrated in FIGS. 15A and 15B tee at any level of the ribs.
Figures 16A, 16B:
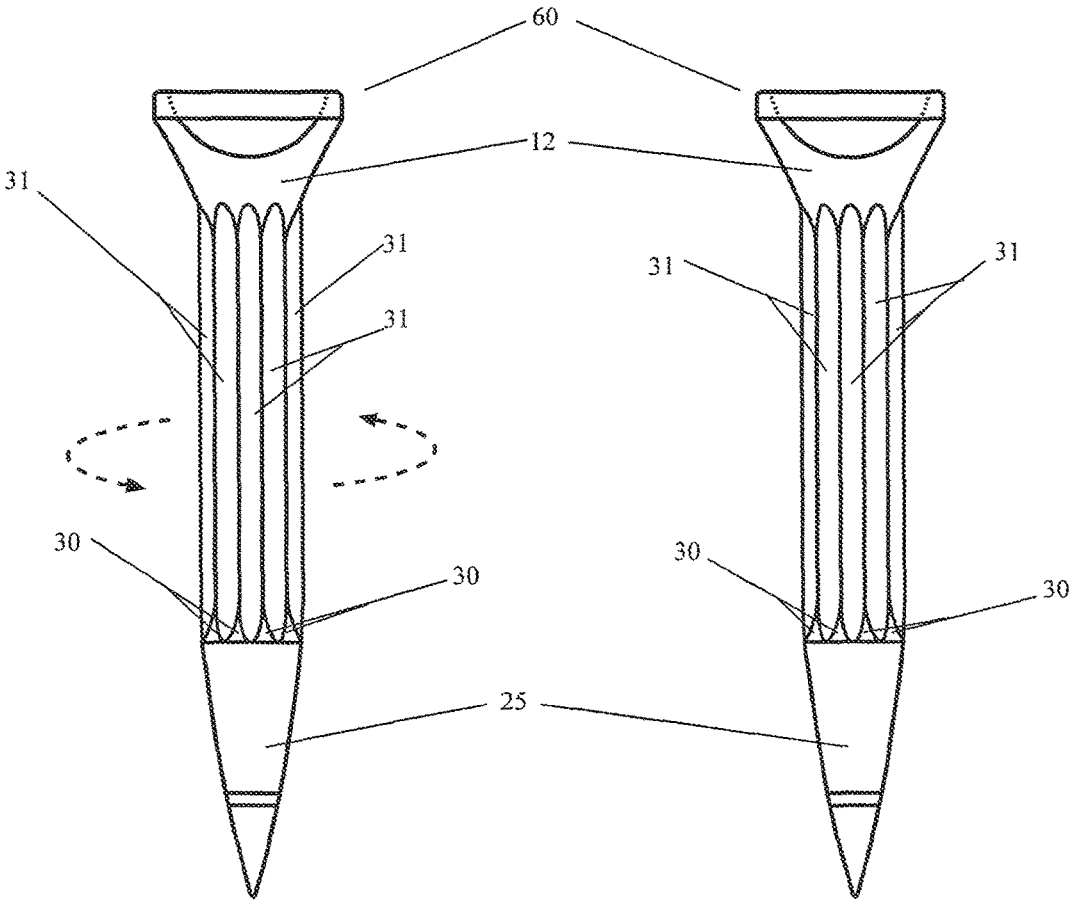
FIG. 16A illustrates a fourth embodiment according to the instant of invention comprising eight non tapered longitudinal ribs.
FIG. 16B shows the back view of the embodiment of the golf tee illustrated in FIG. 16A once it is rotated 180 degrees.
Figure 17:
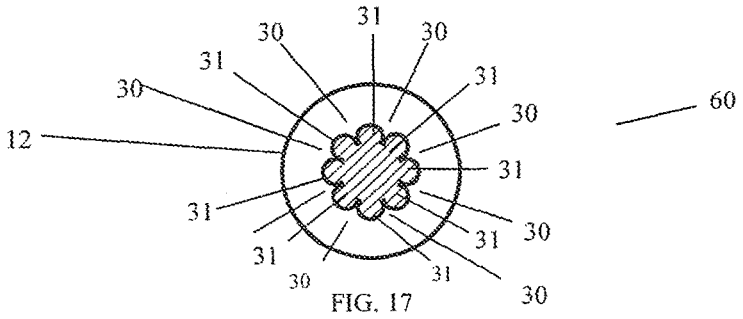
FIG. 17 shows a top view of a cross sectional cut of the embodiment of the invention illustrated in FIGS. 16A and 16B at any level of the ribs.

In a similar manner: front and back of the embodiment 50 is illustrated in FIGS. 12A and 12B, which also the same limitations discussed above for embodiment 10 with the exception that it comprises six grooves 30 and six wing-like ribs 31 equiangularly positioned as illustrated in FIGS. 12A, 12B and FIG. 13. FIG. 13, shows a top view of a cross sectional cut of the golf tee under embodiment 50 cut at any level of the wing-like ribs 31; similarly, front and back of the embodiment 55 illustrated in FIGS. 14A and 14B, which also has the same limitations discussed above for embodiment 10, with the exception that it comprises seven non tapered grooves 30 and seven non tapered wing-like ribs 31 that are equiangularly positioned as illustrated in FIGS. 14A, 14B and FIG. 15. In FIG. 15, shows a top view of a cross sectional cut of the golf tee under embodiment 55 at any level of the wing-like ribs 30; embodiment 60 illustrated in FIGS. 16A and 16B has also the same limitations discussed above for embodiment 10 with the exception that it comprises eight non tapered grooves 30 and eight non tapered wing-like ribs 31, which are equiangularly positioned as illustrated in FIGS. 16A, 16B and 17. On FIG. 17, a top view of a cross sectional cut of the golf tee 55 at any level of the wing-like ribs 30 is shown.

Top and bottom views of embodiments 35, 40, 45, 50, 55 and 60 are not shown nevertheless such views are identical to those for embodiment 10 illustrated in FIGS. 2 and 3 since all golf tee embodiments in the instant invention share the same characteristics of embodiment 10 that are shown in FIGS. 2 and 3 for embodiment 10. The scope of the herein discussed invention comprises all golf tees having any number of non tapered grooves 30 and any number of non tapered wing-like ribs 31, altogether with the limitations already discussed above for embodiment 10.

The herein disclosed tees may be made of plastic, resin, metal, or any other appropriate material by any suitable methods, such as molding techniques. They are easily and economically manufactured, resulting in a low cost in the production and economic sale price.

The grooves 30 and wing-like ribs 31, together with the conical bottom section 25 add stability and grasping strength to the tee once it is inserted into the playing field, providing a much more secure position of the tee and the golf ball while supported in the cup shaped top section 12, which renders excellent results: the stability of the ball on the tee and the reduction of the impact of the golf club on the tee. In this way, it will be easier to find the tee after the ball has been struck since as the ball may be shot at a shorter distance.

While the invention has been described in conjunction with some embodiments, it is to be understood that many alternatives, modifications, and variations will be apparent to those skilled in the art in light of the forgoing description. Accordingly, the invention is intended to embrace all such alternatives, modifications and variations falling within the spirit and scope of the appended claims.

What is claimed is:

1. A golf tee comprising:

(a) a cup-shaped top section comprising:
  (1) an upper end having a concave configuration for receiving and support a golf ball;
  (2) a middle section;
  (3) a lower end; and (b) a non tapered cylindrical intermediate section comprising:
  (1) a first end connected to the lower end of the cup-shaped top section;
  (2) a second end; and (c) a lower section comprising:
  (1) a top truncated conical section, said top truncated section comprising:
    (i) a first end connected to the second end of the non tapered cylindrical intermediate second end;
    (ii) a second end; and
  (2) a bottom conical section, comprising:
    (1) a first end connected to the second end of the top truncated conical section;
    (2) a pointed end; and (d) a grasping section comprising:
  (1) a plurality of non tapered elongated grooves; and
  (2) a plurality of non tapered elongated ribs;

wherein:

each one of the elongated grooves and each one of the elongated ribs of the grasping section are longitudinally positioned from the middle section of the cup-shaped top section to the top truncated conical section of the lower section in the direction of the generatrix of the non tapered cylindrical intermediate section; and wherein:

the described connections between: the cup-shaped top section (a), the non tapered cylindrical intermediate section (b), the lower section (c) and the grasping section (d) constitute and provide a single integral structure.

2. The golf tee as recited in claim 1, wherein the elongated grooves of the grasping section are equiangularly positioned.

3. The golf tee as recited in claim 2, wherein the number of equiangular positioned grooves are two.

4. The golf tee as recited in claim 2, wherein the number of equiangular positioned grooves are three.

5. The golf tee as recited in claim 2, wherein the number of equiangular positioned grooves are four.

6. The golf tee as recited in claim 2, wherein the number of equiangular positioned grooves are five.

7. The golf tee as recited in claim 2, wherein the number of equiangular positioned grooves are six.

8. The golf tee as recited in claim 2, wherein the number of equiangular positioned grooves are seven.

9. The golf tee as recited in claim 2, wherein the number of equiangular positioned grooves are eight.

* * * * *